United States Patent [19]

Koegel

[11] 4,040,276

[45] Aug. 9, 1977

[54] SINKLER CAM SEGMENT

[75] Inventor: Ralph A. Koegel, Brookfield, Wis.

[73] Assignee: Bunker Ramo Corporation, Oak Brook, Ill.

[21] Appl. No.: 596,470

[22] Filed: July 16, 1975

[51] Int. Cl.[2] ..... D04B 15/06

[52] U.S. Cl. ..... 66/107

[58] Field of Search ..... 66/104, 107, 19, 57, 66/115, 31

[56] References Cited

U.S. PATENT DOCUMENTS

| | | | |
|---|---|---|---|
| 537,802 | 4/1895 | Burleigh | 66/107 X |
| 1,092,577 | 4/1914 | Kilbourn et al. | 66/107 X |
| 1,097,733 | 6/1914 | Scott | 66/19 |
| 1,137,561 | 4/1915 | Williams | 66/19 |
| 1,145,930 | 7/1915 | Smith | 66/107 |
| 1,192,328 | 7/1916 | Lawson | 66/107 |
| 3,173,277 | 3/1965 | Fregeolle | 66/107 |
| 3,331,219 | 7/1967 | Brook | 66/107 |
| 3,595,032 | 7/1971 | Reagan | 66/107 X |
| 3,877,256 | 4/1975 | Roque | 66/19 X |

*Primary Examiner*—Mervin Stein
*Assistant Examiner*—Andrew M. Falik
*Attorney, Agent, or Firm*—F. M. Arbuckle; R. J. Schwarz

[57] ABSTRACT

Sinker cam segment having its ends beveled at a compound angle, so that the end surfaces are in a plane having no elements which are either radial or axial with reference to the center line of the cam ring on which the segment is used.

5 Claims, 6 Drawing Figures

FIG. 1
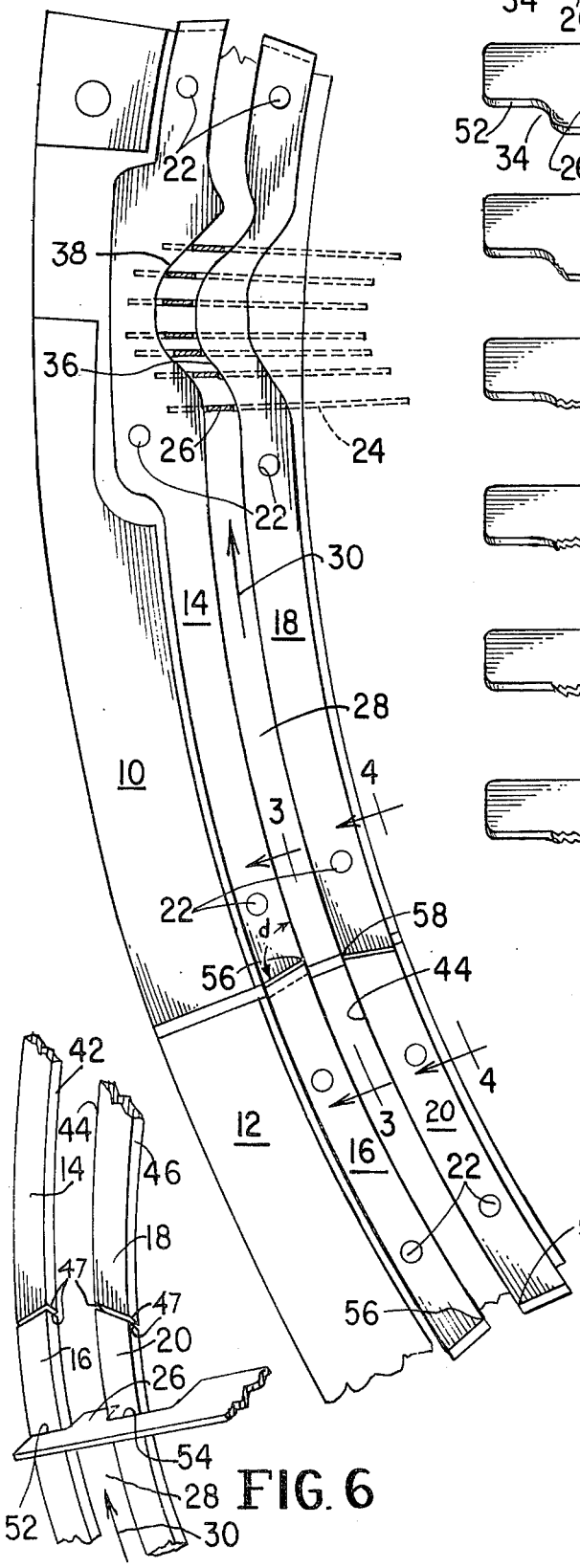
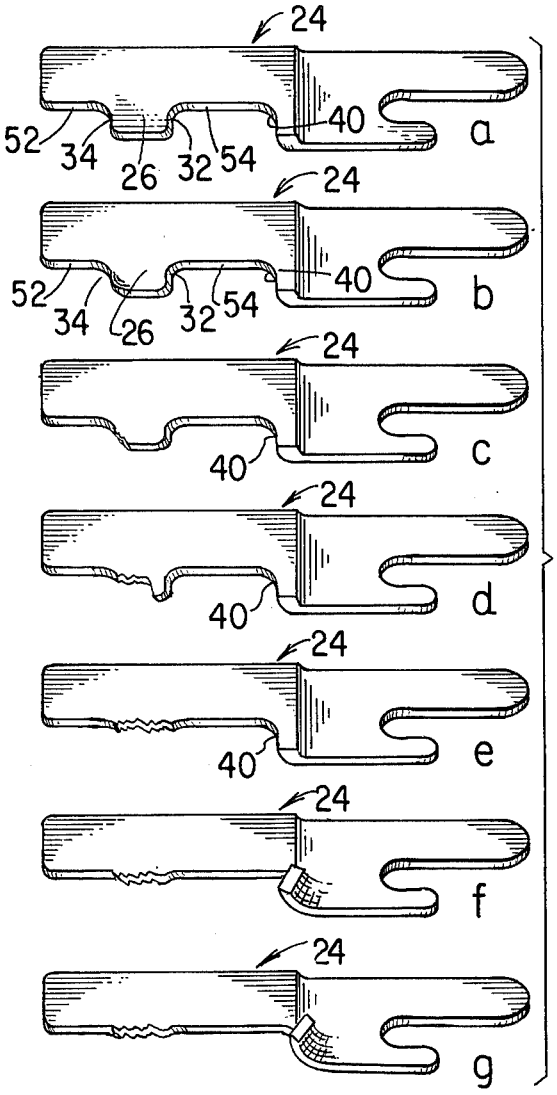
FIG. 2
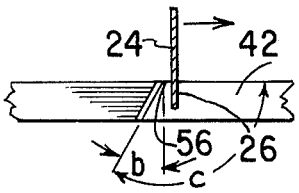
FIG. 3
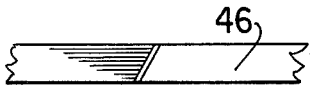
FIG. 4
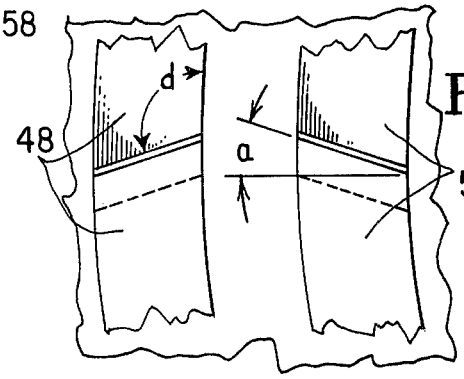
FIG. 5
FIG. 6

SINKLER CAM SEGMENT

SUMMARY OF THE INVENTION

In a circular knitting machine of the type used in the manufacture of deep pile fabric, there is a needle cylinder which supports the individual knitting needles. The needles are reciprocated up and down in vertically extending races by a needle cam as the cylinder rotates. On the upper surface of the needle cylinder, immediately adjacent the needle races, there is a sinker dial containing horizontal races at the same angular spacing around the cylinder as the needle races. The sinker dial rotates with the needle cylinder. Sinkers are reciprocated radially in the horizontal races, movement being controlled by engagement of projecting parts of the sinkers against cam surfaces on a stationary cam ring supported above the sinkers.

Machines of this type are well known in the art, being shown, for example, in U.S. Pat. Nos. 1,582,013 and 3,413,823.

It is common to make the sinker cams in arcuate segments for convenience in installation, and particularly for economy in the replacement of parts which experience the greatest wear in use. The individual segments are attached to the cam ring by pins and screws.

When adjacent segments provide a substantially continuous cam surface, it is desirable that there be no obstruction or gap at the joints between the segments upon which the adjacent edges of sinkers could catch or bump as they move from one segment to the next. A discontinuity can cause rapid wear and possibly breakage of sinkers. A certain amount of hand finishing of the joints is often necessary in order to provide a transition sufficiently smooth to meet requirements.

The problem in the prior art to which the present invention addresses itself is that of sinker wear.

In accordance with the present invention, the segments of the cam are beveled at their ends, in such a way that the sinkers, which lie in planes passing through the center line of the cam ring, will not encounter axial lines of intersection in the axially extending surfaces which they engage, nor radial lines of intersection in the radial surfaces which they engage. This is accomplished by forming the ends of the cam segments at a compound angle, so that the end surfaces are in a plane having no elements which are either radial or axial, with reference to the center line of the cam ring.

A further aspect of the invention consists of arranging the beveled end in such a way that the inside corner of a sinker at the butt passes over obtuse angles on the cam, on both running surfaces, as it arrives at the segment.

BRIEF DESCRIPTION OF THE DRAWINGS

In the accompanying drawings,

FIG. 1 is a bottom view of a portion of a sinker cam ring, with cam segments attached thereto;

FIGS. *2a* through *2g* illustrate the progressive damage to sinkers which may occur with common forms of cam track construction;

FIG. 3 is an enlarged fragmentary detail view taken on the line 3—3 of FIG. 1;

FIG. 4 is an enlarged fragmentary detail view taken on the line 4—4 of FIG. 1;

FIG. 5 is an enlarged fragmentary detail view of that portion of FIG. 1 which is shown in FIGS. 3 and 4; and FIG. 6 is a perspective view of the same part of the cam track as is shown in FIG. 5, illustrating the double bevel at the junction of the cam segments.

DETAILED DESCRIPTION

In FIG. 1, reference numerals 10 and 12 indicate segments of a sinker cam ring, upon which outer cam segments 14 and 16, and inner cam segments 18 and 20, are removably mounted by fastenings 22. It will be understood by those skilled in the art that the complete sinker cam ring, made up of segments such as 10 and 12, is circular, having an axis center line coincident with the center line of the needle cylinder of the knitting machine on which it is used. As is customary, the cam segments are defined by four surfaces running generally in a circumferential direction about said axis center line and two end surfaces generally intersecting said four surfaces. The sinker cam ring is stationary, and is supported above the sinkers.

A typical sinker 24 is shown in FIG. *2a;* it has a butt 26 extending outwardly from one side. A knitting machine may have 750 such sinkers. They are mounted in radial races in a sinker dial (not shown) in such a way that their butts 26 extend into the space 28 between the inner and outer cam tracks. This construction is well known, being seen in U.S. Pat. No. 460,502.

In the present invention the outer cam track is formed by cam segments 14 and 16 and the inner cam track is formed by cam segments 18 and 20. It will be understood that the complete cam tracks are formed by similar segments repeated around the circular sinker cam ring. The cam tracks are stationary, and the sinker butts move between them in the direction indicated by the arrow 30 in FIGS. 1 and 6.

At each position on the machine where yarn is fed to the needles and stitches are formed, the sinkers are retracted and advanced as indicated by the successive positions shown in dotted lines at the top of FIG. 1.

During retraction, the side 32 (FIG. *2a*) of the butt 26 engages against the rise 36 in the inner cam track, causing withdrawal of the sinker. During advance, the portion 38 of the outer cam track engages side 34 of the butt, thrusting the sinker toward the center of the cam circle, i.e., toward the right in FIG. 1.

It is important that the joints between adjacent segments of the cam tracks align as well as possible, and careful hand stoning is often resorted to in obtaining the desired result. With the emphasis on economy of labor, however, ideal results are not always obtained, and because of the tolerances involved in manufacture and mounting of the segments, there may be a gap between adjacent segments after they are mounted. In any event there is of necessity some finite space between adjacent segments, and in the accompanying drawings the space is exaggerated for clarity of illustration.

If the ends of the segments are cut "square", that is if the joint at their ends is parallel to the plane of the sinkers which move across it, each sinker as it passes may tend to be caught in the joint, particularly if there is a gap or abrupt change in level at a junction point. Progressive damage to sinkers may occur in such a case.

FIGS. *2a* to *2g* show stages of breakdown which have been observed. The case illustrated occurred where the side 34 of the butt encountered a gap or an abrupt offset or change in the level of the cam surface facing it. In FIG. *2b,* the outer corner of the butt has been curled by successive impacts against the abrupt change in level, and in FIG. *2c* the corner has actually broken off. In FIG. 2*d* the breakdown has proceeded further, until in FIG. 2*e* the butt has been entirely stripped away. With control of sinker position by the butt no longer possible, the heel 40 of the sinker may encounter similar difficulties, causing it to peel up and shred away as shown in FIGS. 2*f* and 2*g*.

It will be obvious that sinkers so damaged may be the cause of various imperfections in the knitted product, but the most catastrophic result is that the loose particles of metal broken off from a sinker may become wedged in the races, or at other points which have limited clearances, and this can bring the machine to a grinding halt, usually with the breakage of numerous sinkers, and possible damage to other parts of the apparatus.

Disassembly and careful clean-up and repair are required, and the stoppage is costly in terms of labor, replacement parts, and lost production.

It should therefore be clear that it is desirable to have a joint which will provide a smooth transition from one segment to the next with no appreciable added cost in manufacture, and one requiring a minimum of hand fitting for installation.

U.S. Pat. No. 537,802 shows angular joints as seen in plan view, which could be an aid to transition for edges of the sinkers which traverse the plane face of the cam, but does not solve the problem causing damage of the kind shown in FIGS. 2*a* to 2*g* herein.

According to the present invention, the desired result is obtained by forming the mating ends of the cam segments at a compound angle, so that the cylindrical running surfaces 42, and 44 and surface 46, generated by elements extending parallel to the center line of the cam ring, have joints formed by corners 47 (FIG. 6) at the ends of the segments involved, which corners are along lines which are not parallel to the center line of the cam ring but are at an angle thereto. Similarly, the running surfaces 48 and 50 of the cam segments, lying in a plane perpendicular to the center line of the cam ring, have joints formed by corners at the ends of the segments involved, which corners are along lines which are not on a radius from the center line of the cam ring but are at a generally oblique angle thereto. Stating the conditions generally, the plane of the end surface of a segment must be one which has no elements which are either radial or axial, with reference to the center line of the cam ring to which the segments are fitted.

By this invention it is assured that both the edges 52 and 54 of the sinkers which traverse the planar surfaces 48 and 50 of the cam tracks, and also the edges 32 and 34 which traverse the cylindrical surfaces 42 and 44 of the cam tracks, are supported at all stages of movement across a joint between cam segments.

As a practical matter, considering the thickness of the sinkers, with the form of joint provided by this invention, there can be a gap greater than the thickness of the sinkers without any danger that they will drop into or be caught in the gap. This is because the gap is diagonal to the edge of the sinker which runs across it (see FIG. 3), and the edge will at all times during the passage be supported by one or the other of the segments.

Where the length of the sinker edge engaging the cam if relatively long, the diagonal angle need not be very great. The length of the sinker edges 52 and 54 engaging the surfaces 48 and 50 of the cam segments is in many cases such that an angle of 12° or 15° (FIG. 5, angle *a*) from a radius through the center line will be satisfactory. On the other hand, with the shorter bearing of the edges 32 and 34 of the butt 26 against the cam surfaces 44 and 42 respectively, a greater angle is preferred, shown as about 30° (FIG. 3, angle *b*) with respect to the center line of the cam ring 10, 12.

It is further desirable that the geometry of the joints be so arranged that an inside butt corner of a sinker, as it arrives at a cam segment, passes over obtuse angles in both of the running surfaces of the cam which enter that corner of the sinker.

For simplicity in use of the terminology in the claims, it is desirable to define what is meant.

With sinkers of the design illustrated herein, the inside butt corners are those at the intersections of edges 34 and 52, and of edges 32 and 54. In some machines (as in U.S. Pat. No. 1,582,013) the sinker does not have an extension rearward of the butt, so there is no inside butt corner corresponding to the intersection of edges 34 and 52 in FIG. 2*a* herein. Hence the use of the terminology "at least one inside corner" in some of the following claims.

The running surfaces of a cam segment are those which pass adjacent to those edges of a sinker which form an inside butt corner as above defined.

With reference to the inside butt corner formed by the intersection of edges 34 and 52, the obtuse angles which the sinker passes over as it arrives at cam segment 14 are angle *c* (FIG. 3) in running surface 42 and angle *d* (FIGS. 1 and 5) in running surface 48, at corner 56. Cam segment 18 has corresponding angles in running surfaces 44 and 50 at corner 58.

Some changes and adaptations may be made, according to the thickness of the sinkers used, and the gap sizes found by experience to be common in particular shops or machines. The scope of the invention is defined by the following claims.

I claim:

1. For use in a knitting machine having a circular cam ring extending about an axis center line, a removable cam segment for said sinker cam ring, said cam segment having a sinker-actuating cam surface formed thereon facing said axis center line, generated by elements parallel to said axis center line, and said segment having corners at the intersection of the ends thereof and said cam surface and which corners are along lines which are at a generally oblique angle to said axis center line and complementary to adjacent corners in joints with said cam ring.

2. A cam segment as defined in claim 1, wherein said angle is approximately 30°.

3. A cam segment as defined in claim 1, for use with sinkers having a body portion and a butt portion and an inside corner at an intersection of said body portion and said butt portion, said cam surface at the end thereof which is traversed by said inside corner of a sinker as said sinker arrives at said cam segment having an angle greater than 90° included between the end of said segment and the edge of said cam surface traversed by said inside corner of a sinker.

4. For use in a knitting machine having a circular sinker cam ring extending about an axis center line, a removable cam segment for said sinker cam ring defined by four surfaces running generally in a circumferential direction about said axis center line and two end surfaces generally intersecting said four surfaces, with at least one of said end surfaces lying in a plane which has no elements which are either radial or axial with respect to said axis center line of said sinker cam ring when said segment is mounted on said sinker cam ring.

5. A cam segment as defined in claim 4, for use with sinkers having a body portion and a butt portion and at least one inside corner at an intersection of said body portion and said butt portion, said cam segment having running surfaces passing adjacent to those edges of a sinker which form said inside corner, said cam segment further having obtuse angles in said running surfaces at the corners thereof traversed by said inside corner of a sinker as said sinker arrives at said cam segment.

* * * * *